US005951146A

United States Patent [19]

Lin

[11] Patent Number: 5,951,146

[45] Date of Patent: Sep. 14, 1999

[54] NETTED LAMP DEVICE IN VARIOUS MATRIX ARRANGEMENTS

[76] Inventor: Shwu-Miin Lin, 5F, No. 50, Lane 260, Kwangfu South Road, Taipei, Taiwan

[21] Appl. No.: 08/872,980

[22] Filed: Jun. 11, 1997

[51] Int. Cl.[6] ..... F21P 3/00; F21V 21/16

[52] U.S. Cl. ..... 362/252; 362/251

[58] Field of Search ..... 362/123, 249, 362/251, 252, 806

[56] References Cited

U.S. PATENT DOCUMENTS

| | | | |
|---|---|---|---|
| 5,645,342 | 7/1997 | Chang | 362/252 |
| 5,662,409 | 9/1997 | Huang | 362/249 |
| 5,667,295 | 9/1997 | Tsui | 362/252 |
| 5,669,707 | 9/1997 | Huang | 362/249 |
| 5,716,124 | 2/1998 | Hsu | 362/252 |
| 5,791,765 | 8/1998 | Lin | 362/249 |

*Primary Examiner*—Alan Cariaso
*Attorney, Agent, or Firm*—Dougherty & Troxell

[57] ABSTRACT

A netted lamp device in a pattern of a matrix, including some lamp strings braided intercrossingly to form a lamp decoration, wherein, the lamp strings are braided intercrossingly with their conductors, the lamps on the matrix in some of the lamp strings are optionally arranged in pursuance of a designed pattern or letter, while the lamps in the outer ones of the lamp strings are arranged regularly along the boundary of the frame for the netted lamp device to form the peripheral edges of the netted lamp device; the lamp strings are controlled and driven by an external IC for some individual switches corresponding respectively to the lamp strings, so that a designed pattern or letter in pursuance of the matrix can be formed in the lamp decoration.

6 Claims, 19 Drawing Sheets

"A"

NETTED LAMP DEVICE IN VARIOUS MATRIX ARRANGEMENTS

BACKGROUND OF THE INVENTION

1. Field of the Invention

The present invention is related to a netted lamp device in a pattern of one of various matrices, and especially to a netted lamp device wherein the miniature lamps are braided intercrossingly to render the miniature lamps to be arranged to form a decorative pattern or a letter, the braided pattern can even become more variant patterns or letters by controlling of individual switches.

2. Description of the Prior Art

A conventional Christmas lamp string mostly is made to be a specified lengthy linear lamp string, the bulbs of the lamp string are lightened to emit light or flash. The variety of such conventional Christmas lamp string is limited, for example, it can only be arranged in a V shape to be wrapped around a Christmas tree. In view of this, a plurality of frameworks imitating a star or a Christmas tree etc. are designed, wherein, the miniature lamps are embedded in the frameworks to function as a shining star or a shining Christmas tree. However, decorative variety thereof is still limited, yet the accessory framework imitating the star or the Christmas tree etc. occupies quited a large volume and is not suitable for packaging and shipping.

In order to break through the limitation of the lamp strings, products such as net lights or knitting lights are sold in the markets, the most outstanding function of such net lights or knitting lights is that, each of them can be individually hung for decoration, or can be adhered on a flexible base to form any desired pattern, i.e., the lamp string is combined to the flexible base, so that pattern of the whole lamp string is more abundant in variation, the lamp string is further rollable with the flexible base to reduce their occupying space. Moreover, the net lights or knitting lights can be conveniently wrapped directly on an article to be decorated (such as on a Christmas tree). Regardless of the advantages owned by such net lights or knitting lights, variety in flashing of the lights can only be decided by flashing speed or color of the miniature lights. Thus the light emitting and flasing functions thereof are still insufficient.

SUMMARY OF THE INVENTION

The object of the present invention is to provide a netted lamp device in a pattern of one of various matrices, and especially a netted lamp device wherein a plurality of lamp strings each having an individual loop are optionally braided intercrossingly to form a network of the decorative patterned lamps, such optionally intercrossing arrangement of each lamp string can form various braided patterns and letters by controlling the individual switches of the above mentioned lamps, which switches are controlled by a single chip integrated circuit having therein an internally preserved control program, the integrated circuit is driven by the program to form a single output or a series of serial or intermitent outputs, in order that a plurality of lamp strings create more variant flasing, so that the decorative braided lamps can provide much more abundant decorative functions of patterns or letters.

The present invention will be apparent in its novelty and characteristics after reading the detailed description of the preferred embodiments thereof in reference to the accompanying drawings.

DETAILED DESCRIPTION OF THE PREFERRED EMBODIMENT

Figure 1:
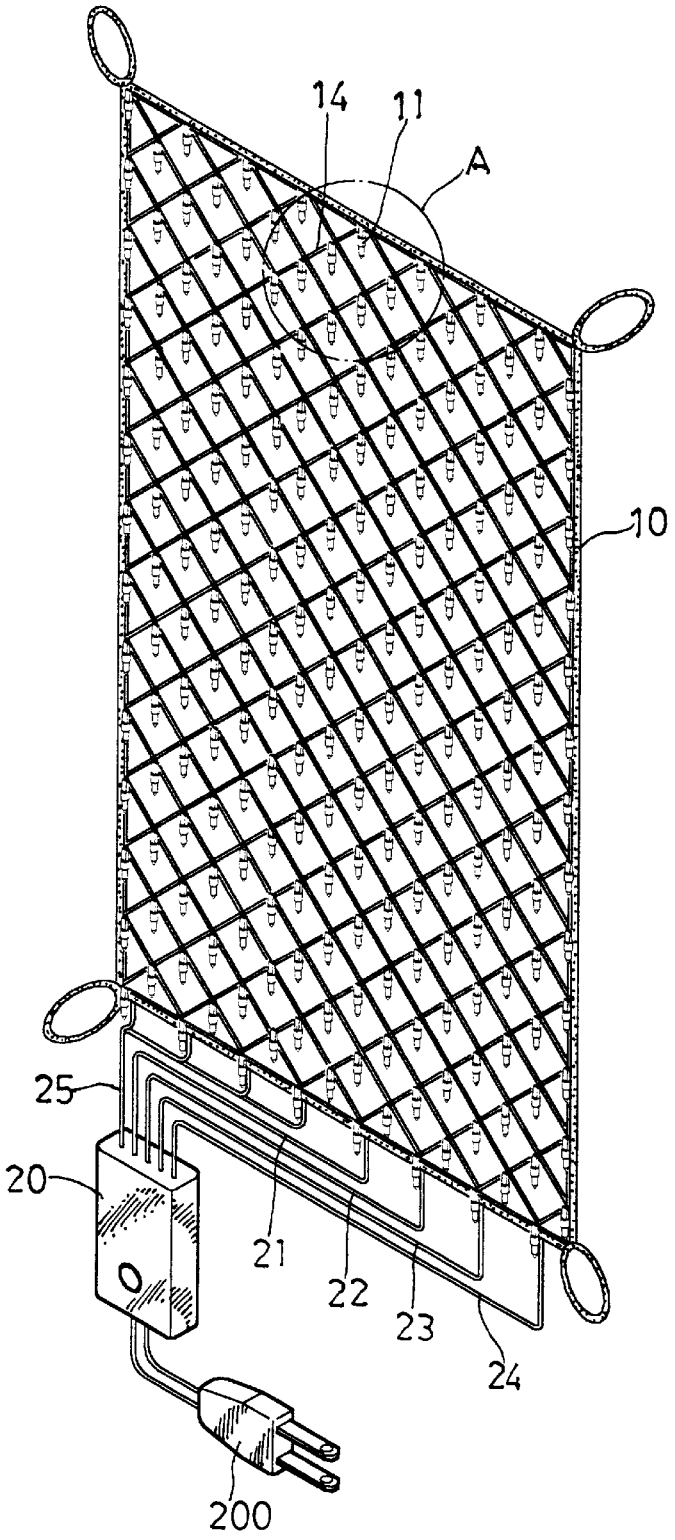
FIG. 1 is a perspective view of an embodiment of the present invention.
Figure 2:
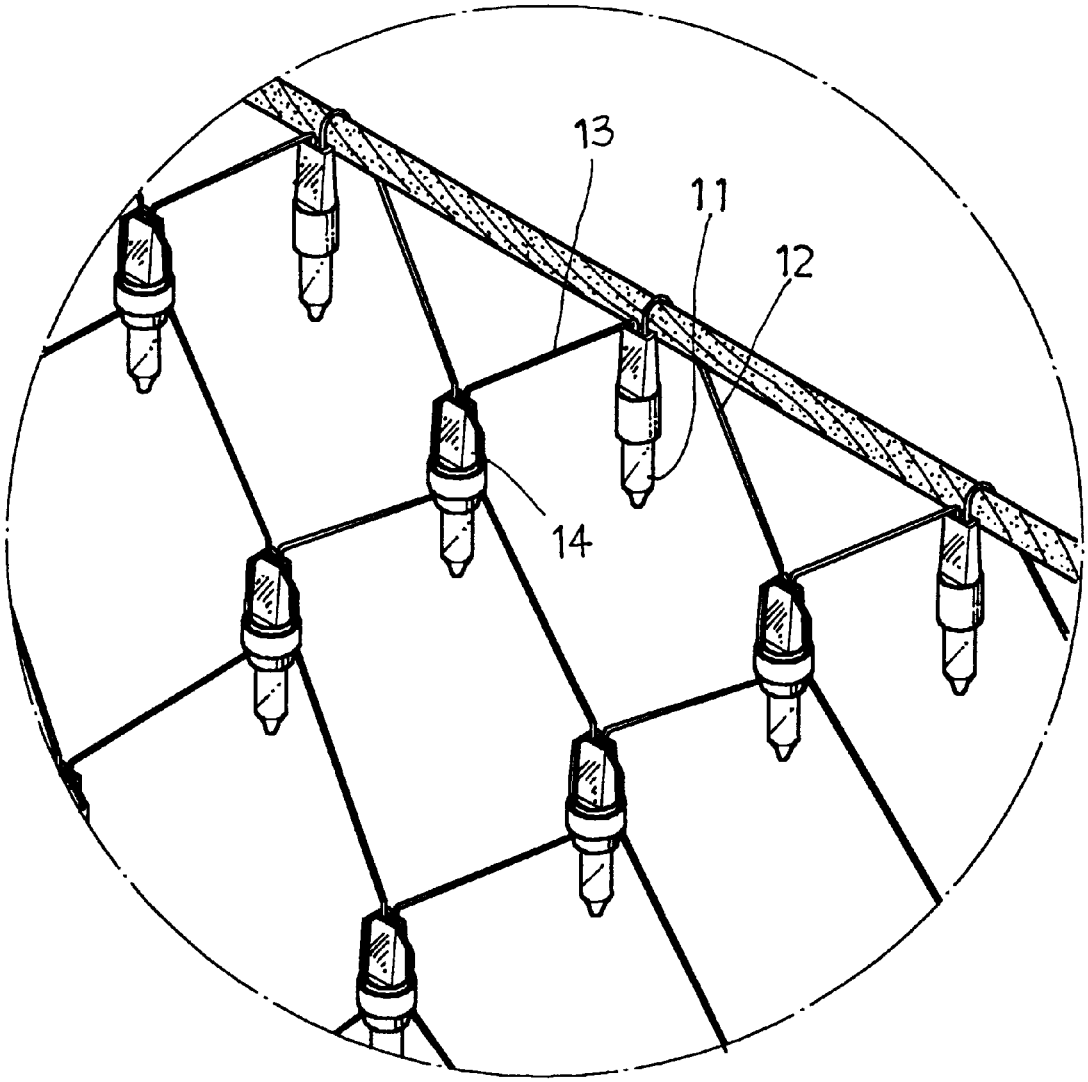
FIG. 2 is a partial enlarged view of the A part in FIG. 1 of the present invention.

Referring to FIGS. 1 and 2, the present invention is comprised generally of a plurality of miniature lamps braided into a decorative pattern with suitable area. In the preferred embodiment as shown in the drawings, the decorative lamps are used with a peripheral frame 10 made of flexible material and of suitable size, wherein, the most outside miniature lamp 11 closest to an edge of the frame 10 has its one conductor 12 wrapped over the frame 10, while has the other conductor 13 is connected to a lower miniature lamp 14. The miniature lamp 14 is further connected to other lower miniature lamps, the latter are braided in pursuance of such braiding mode all the way during adding of the lamp strings to form the whole decorative lamp device.

A control box 20 comprising a control circuit is provided exteriorly of the decorative lamps, which control box 20 can be connected to the power source through a plug 200. In the preferred embodiment as shown in the drawings, the whole decorative lamp device includes four individual loops, the control box 20 is connected to the lamps via the conductors 21, 22, 23, 24 and a grounding loop wire 25.

Figure 4:
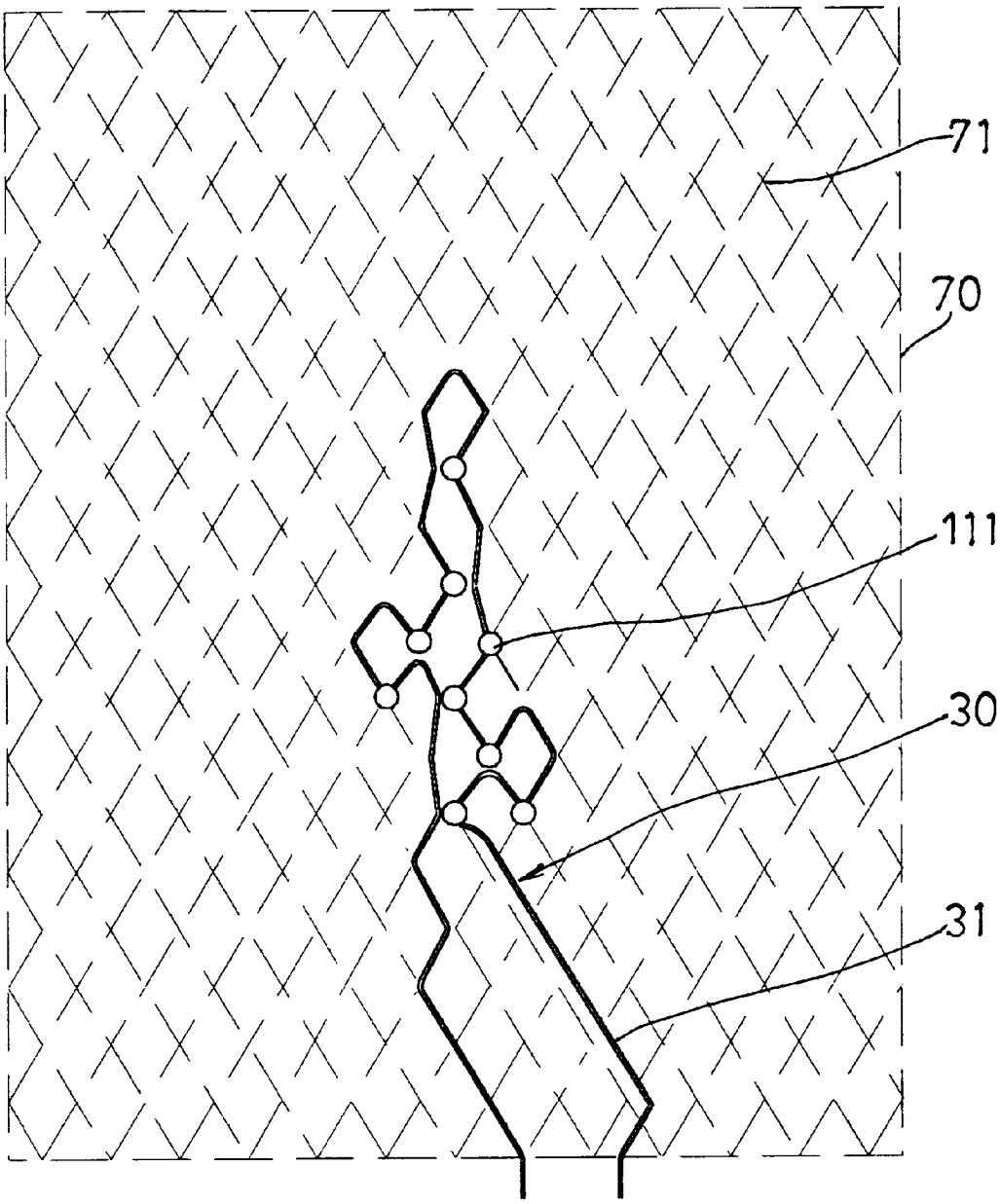
FIG. 4 is a schematic view showing the first set of the lamp strings of the present invention.
Figure 5:
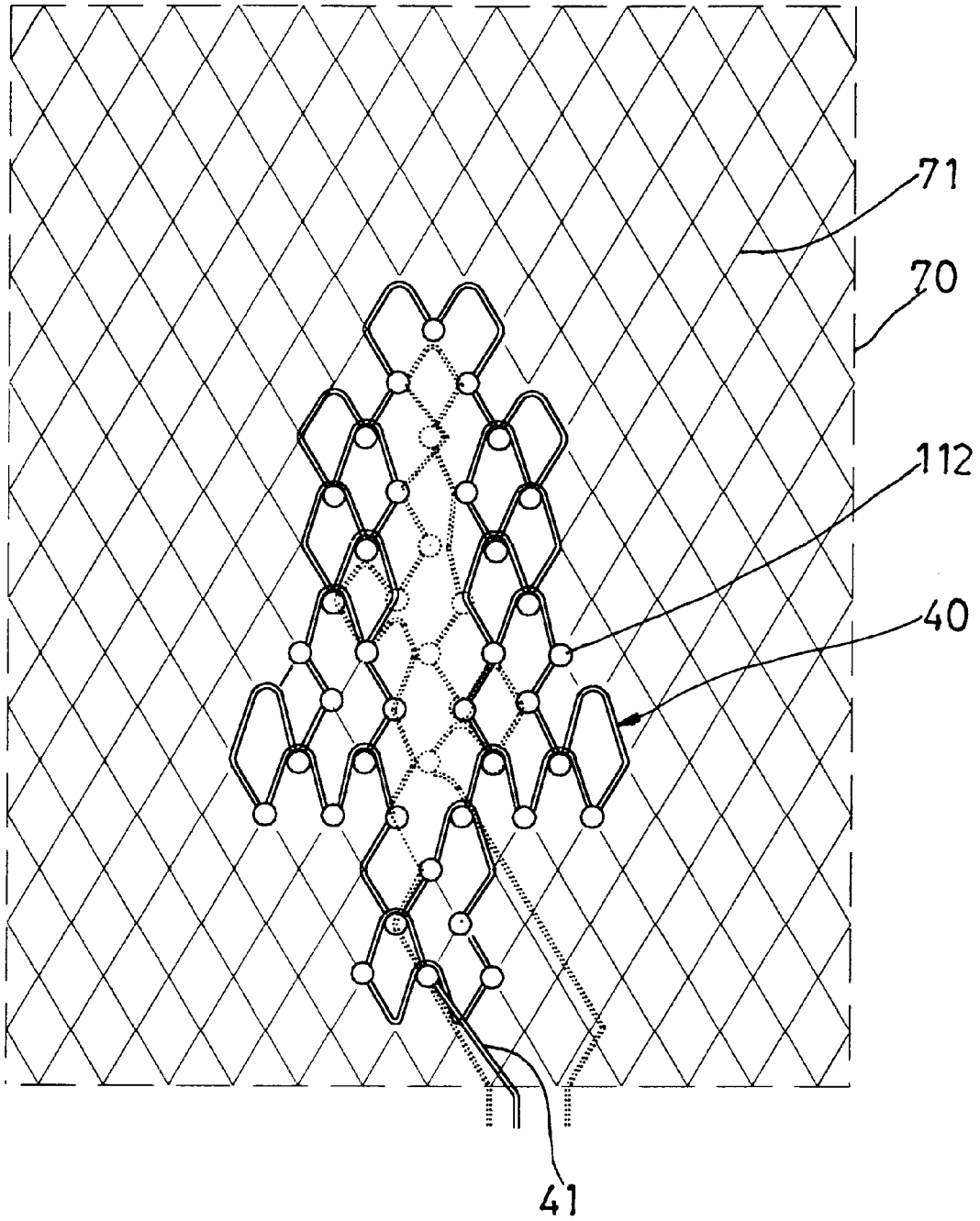
FIG. 5 is a schematic view showing a second set of the lamp strings is added to the first set of the lamp strings of FIG. 4 of the present invention.
Figure 6:
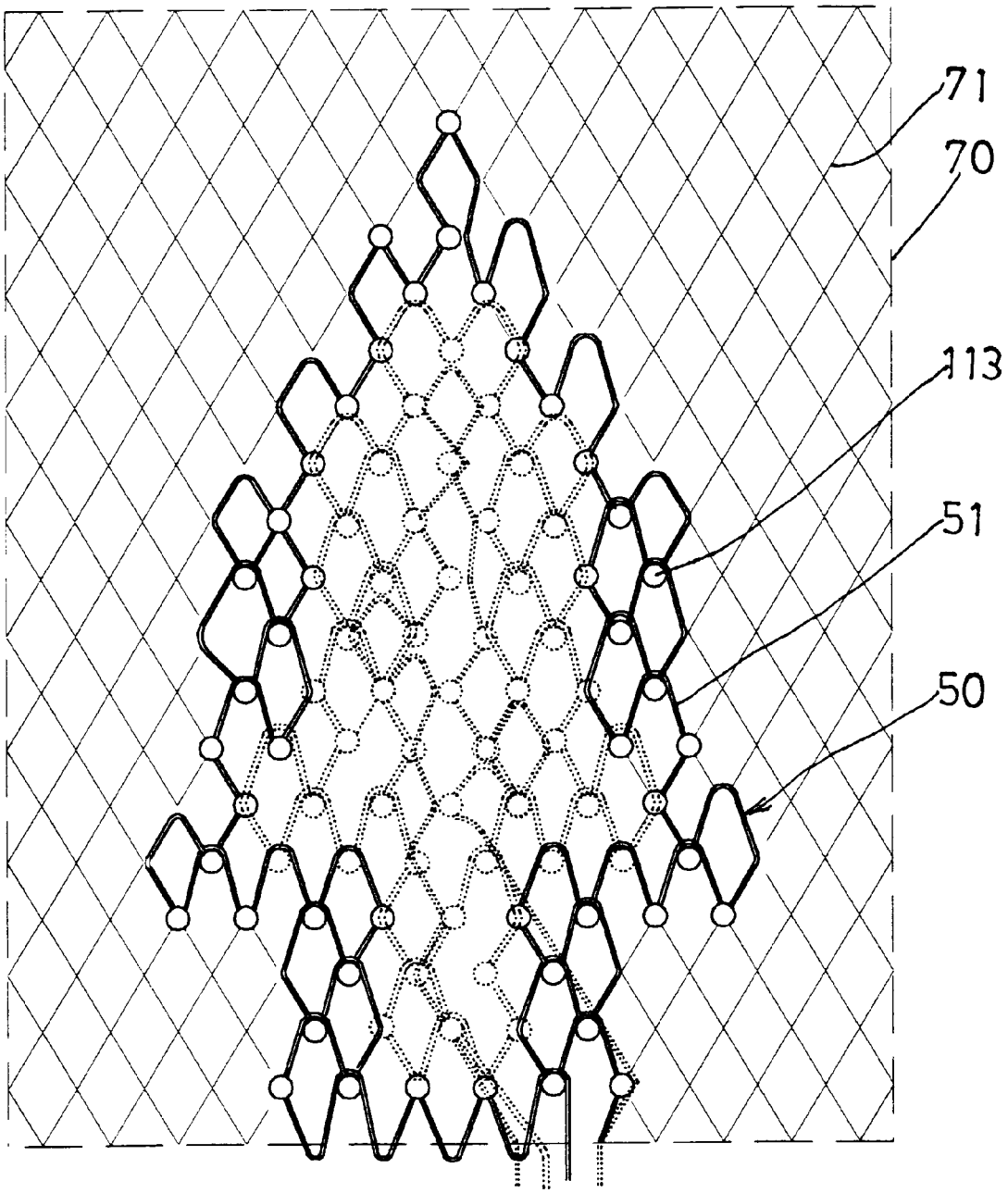
FIG. 6 is a schematic view showing a third set of lamp string is added to the first set and the second set of the lamp strings of FIGS. 4 and 5.
Figure 7:
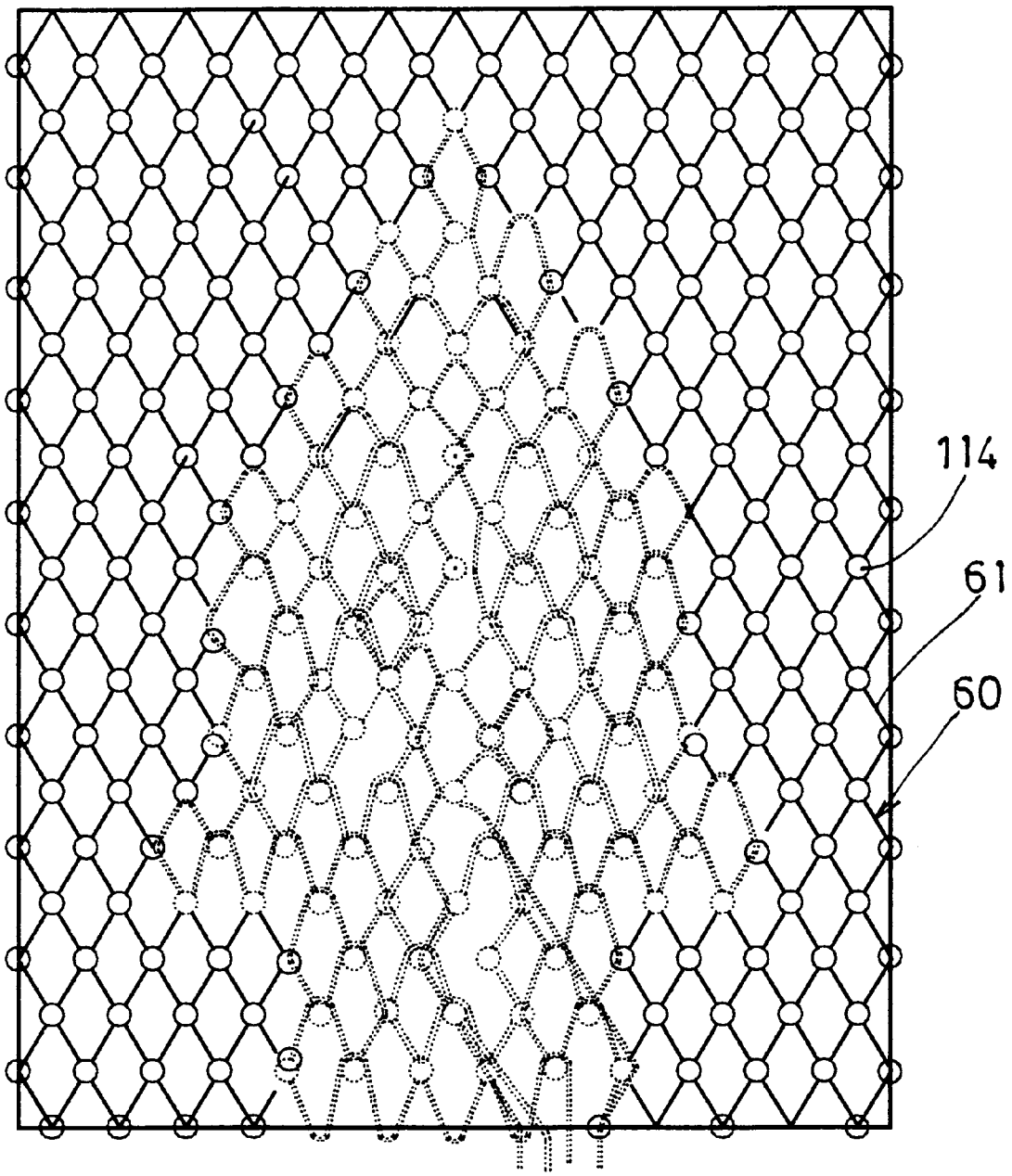
FIG. 7 is a schematic view showing a fourth set of lamp string is added by braiding according to the way of FIGS. 4 and 5 along the outer edges of the lamp strings braided.

Referring now to FIG. 4, the decoration panel 70 to be braided is given a suitable area, the panel 70 can be composed of a plurality of intersection points 71 which form the whole matrix of the decorative lamps. In the preferred embodiment as shown in the drawings, a miniature lamp is provided at each intersection points 71. In the preferred embodiment as shown in FIG. 4, a first lamp string 30 is provided with conductors 31 as are requested by actual requirement in design, and is provided with a plurality of miniature lamps 111 arranged optionally in pursuance of a designed pattern or letter and located at the intersection points 71. And as shown in FIG. 5, a second lamp string 40 is extended tortuously along the outer edges of the braided first lamp string 30 to render the conductors 41 thereof to intercross with the conductors 31 of first lamp string 30 and is braided therewith. The miniature lamps 112 of the second lamp string 40 are positioned to fully fill the empty intersection points 71 around the first lamp string 30; in the same way, as is shown in FIG. 6, a third lamp string 50 is also braided to combine with the second lamp string 40. In the preferred embodiment as shown in FIG. 7, the most outside lamp string 60, i.e., the fourth lamp string 60, forms in a regular way along the boundaries of the frame the peripheral edges. According to the above statement, the first to the fourth lamp string 30, 40, 50, 60 can beside form the desired patterns or letters directly during turning on the electric power by using different colors on the miniature lamps 111, 112 and 113, 114, they can further have more variety under the following driving and control mode of the circuit.

Figure 3:
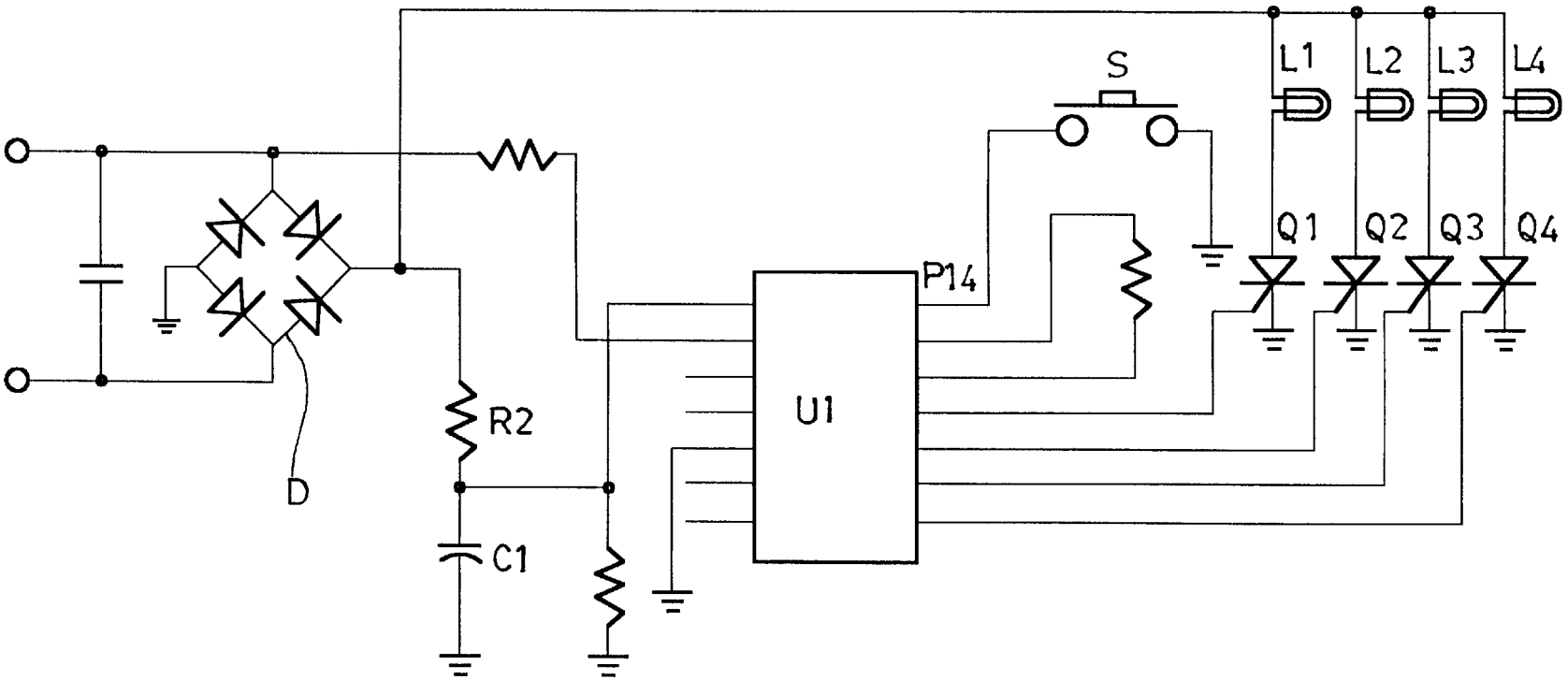
FIG. 3 is a view of an embodiment of the circuit of the present invention.

Please refer to FIG. 3, in the embodiment of the circuit, current from the power supply is firstly rectified by a rectifier D to form a DC voltage which is filtered by R2 and C1 and is supplied for a single chip integrated circuit U1 with working voltage. The single chip integrated circuit U1 is an output control unit which can be preserved with the control program for required lamp flashing and changing of pattern, in order to control changing at the output terminal of the single chip integrated circuit U1, the output terminal is connected to the triggering ends of the four switches Q1, Q2, Q3 and Q4, according to the embodiment shown in the drawing, the switches Q1, Q2, Q3 and Q4 can be silicon-controlled rectifiers (SCR), the output terminals of the four switches Q1, Q2, Q3 and Q4 are connected respectively to the lamp bulbs L1, L2, L3 and L4. When the activating terminal 14 of the single chip integrated circuit U1 is grounded through a push button switch S, the integrated circuit U1 is driven by the program to give a single output or a series of serial or intermitent outputs to control changing of flashing of the lamp bulbs L1, L2, L3 and L4.

Figure 8:
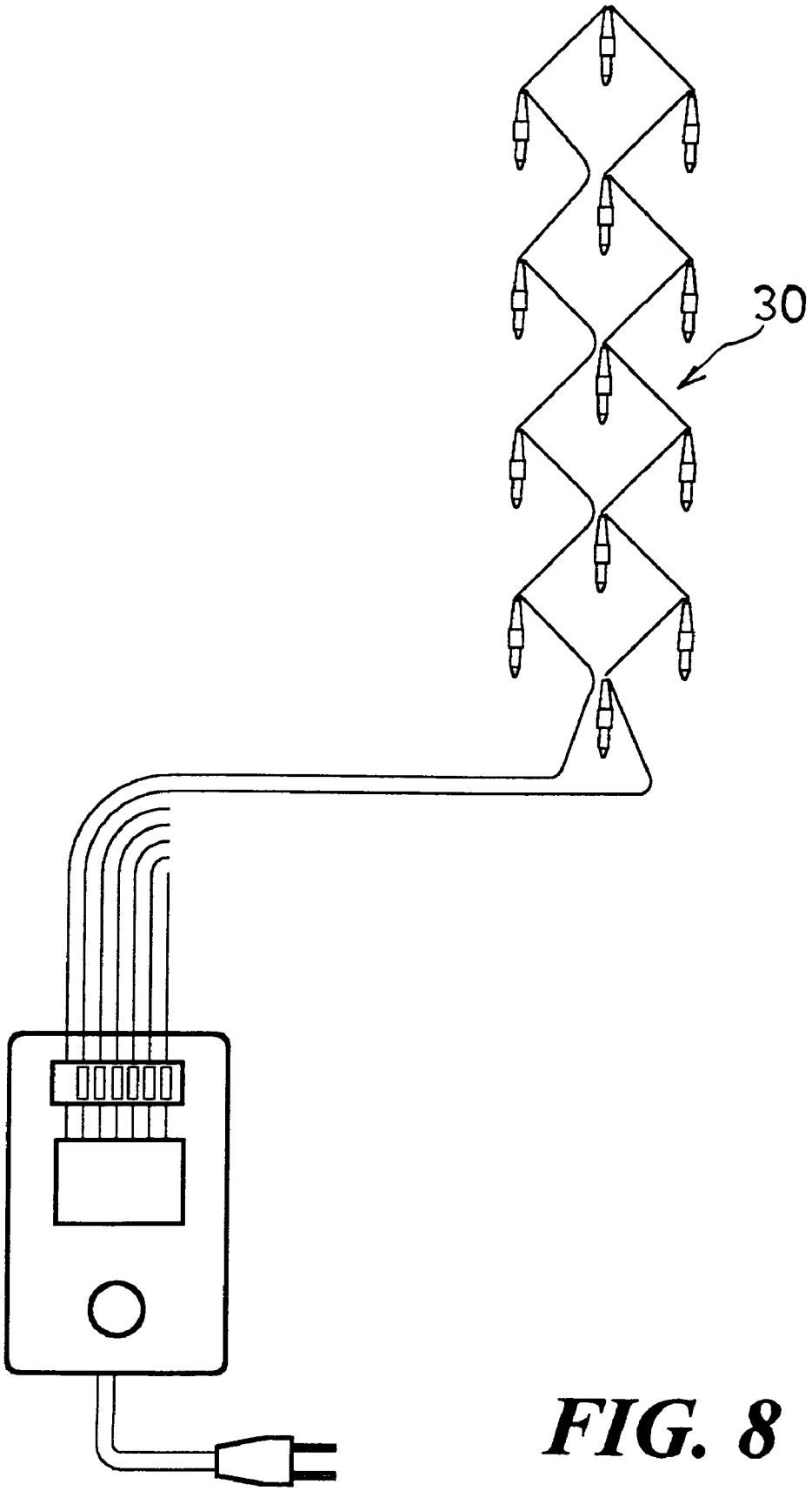
FIGS. 8–10 are the schematic views showing embodiments of wire connecting.
Figure 9:
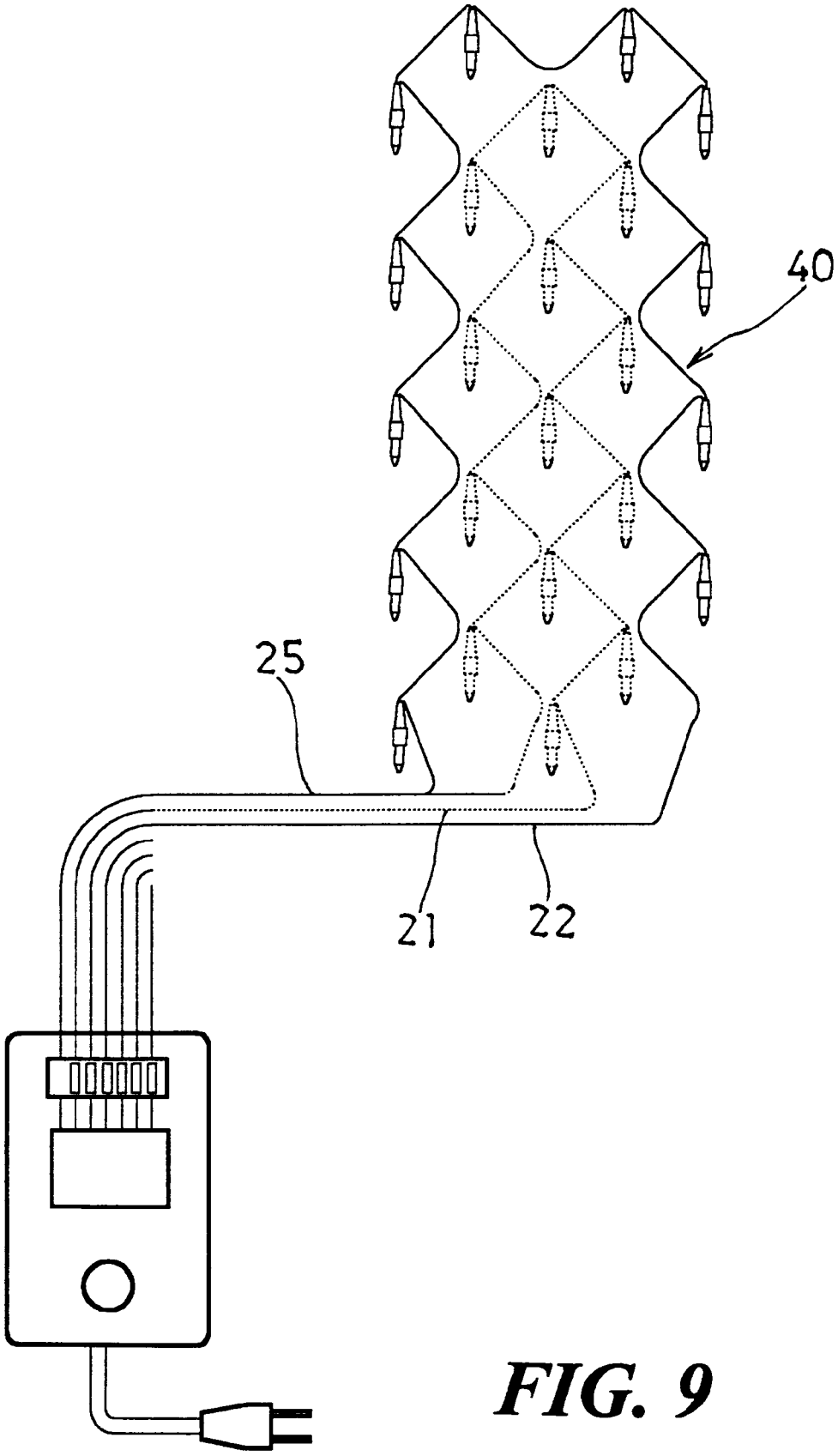
Figure 10:
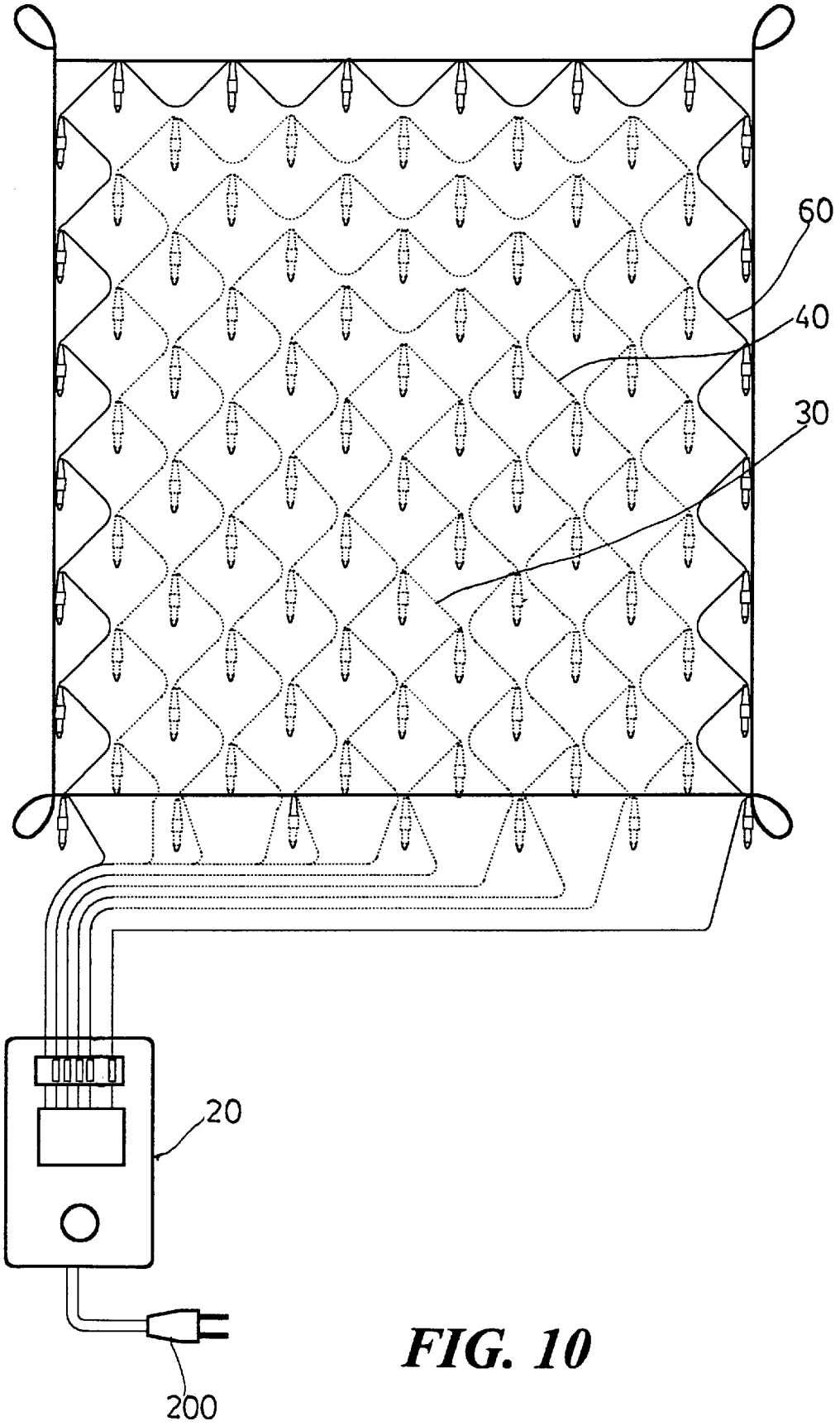

FIGS. 8–10 are views showing the basic structures of individual loops of lamp string, in FIG. 8, the first conductor 21 and the grounding loop wire 25 form an inner first loop with the lamp string 30, while in FIG. 9, the second conductor 22 and the grounding loop wire 25 form an outer second loop with the lamp string 40, and so forth, a braided lamp decoration including multiple loops can be formed as is shown in FIG. 10.

Figure 11:
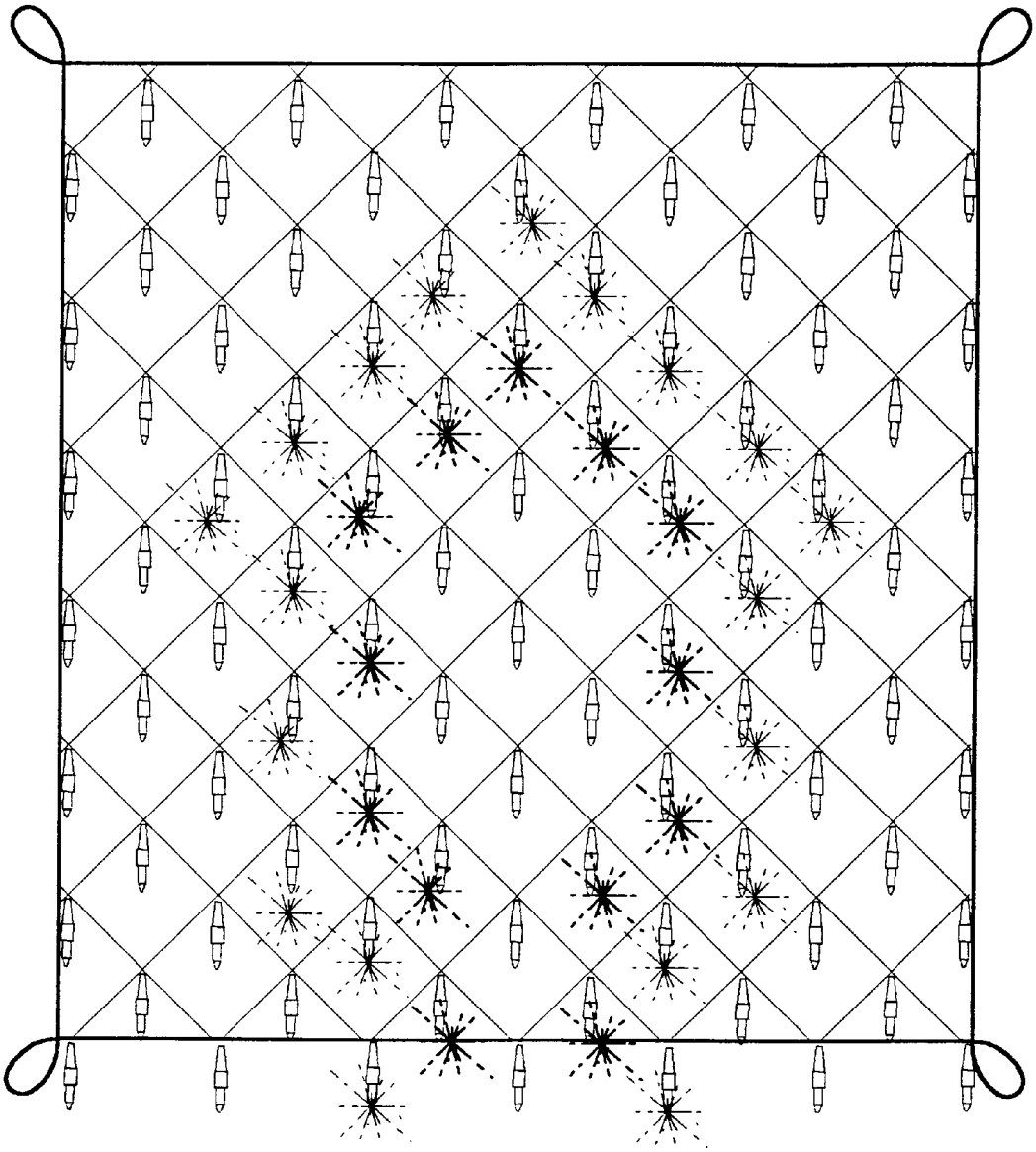
FIGS. 11–13 are the schematic views showing modes of light flashing of the present invention.
Figure 12:
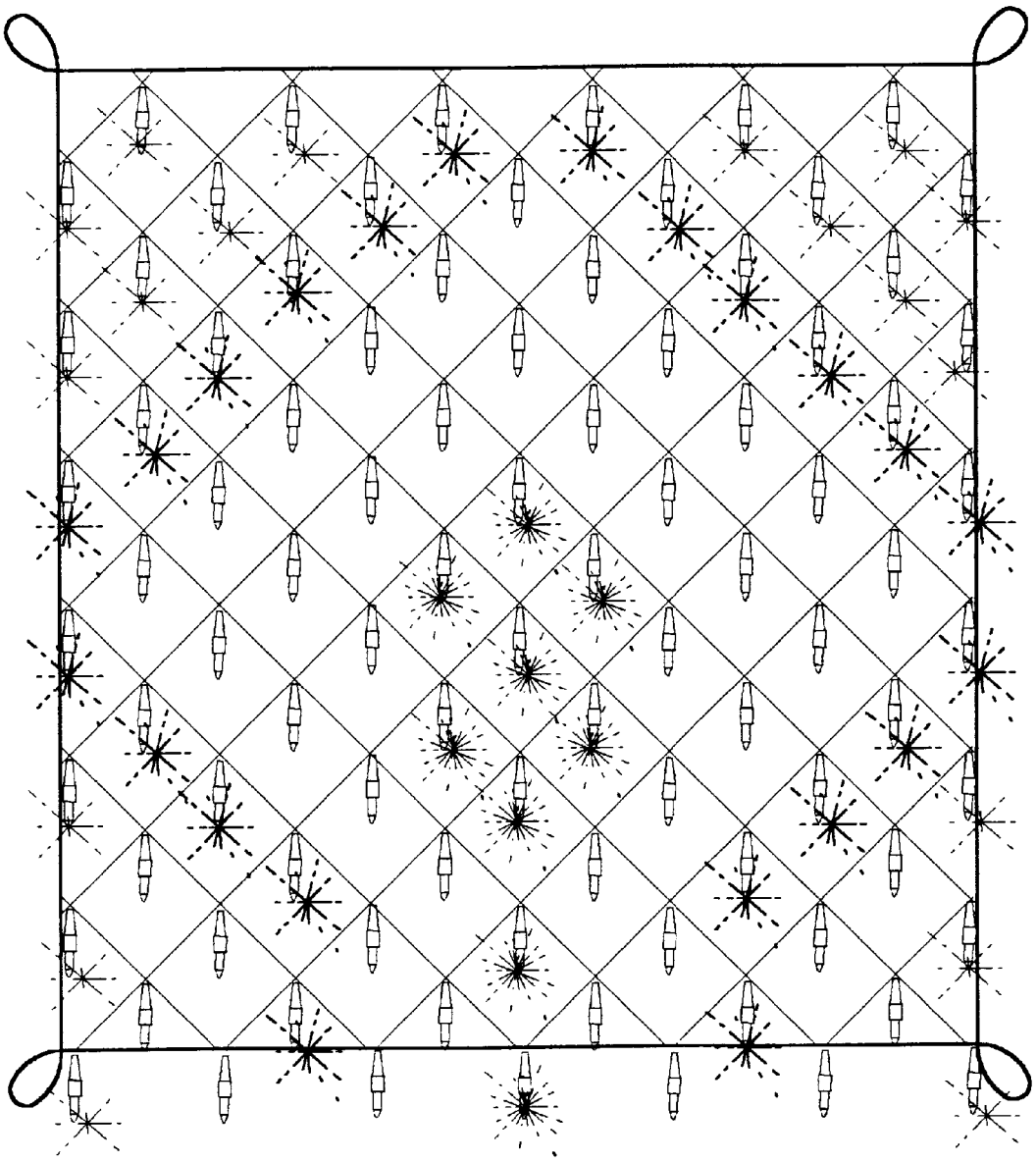
Figure 13:
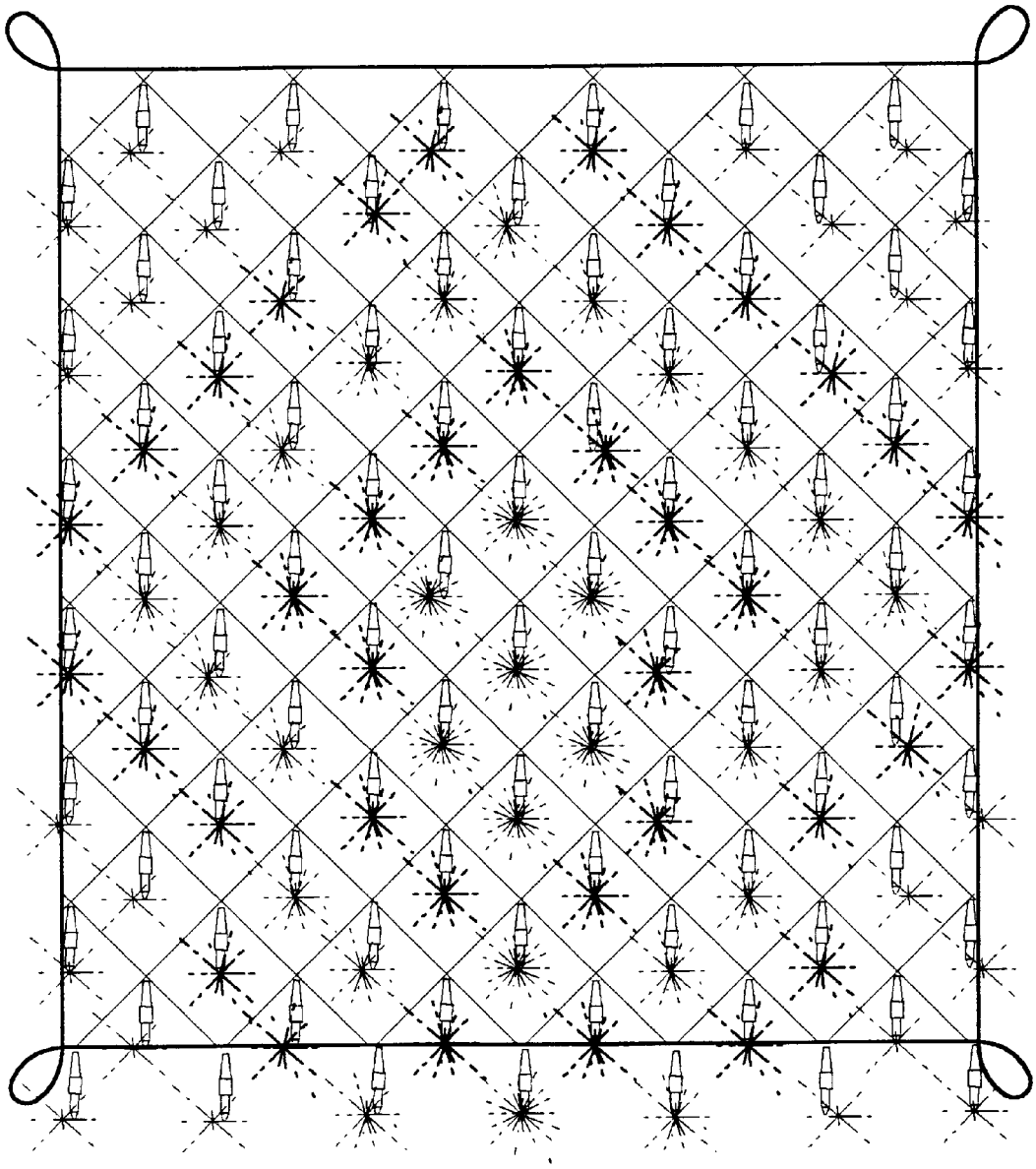

As shown in FIG. 11, at least one set of lamp string optionally arranged in the whole lamp decoration of the present invention is controlled for lightening or unlightening by the above mentioned internal control program of the single chip integrated circuit U1, or as shown in FIG. 12, control of lightening or unlightening of the inner optionally arranged lamp string and the outer regularly arranged (along the boundary of the frame) lamp string is effected, and the whole lamp strings can also be certainly controlled for lightening as is shown in FIG. 13.

Figure 14:
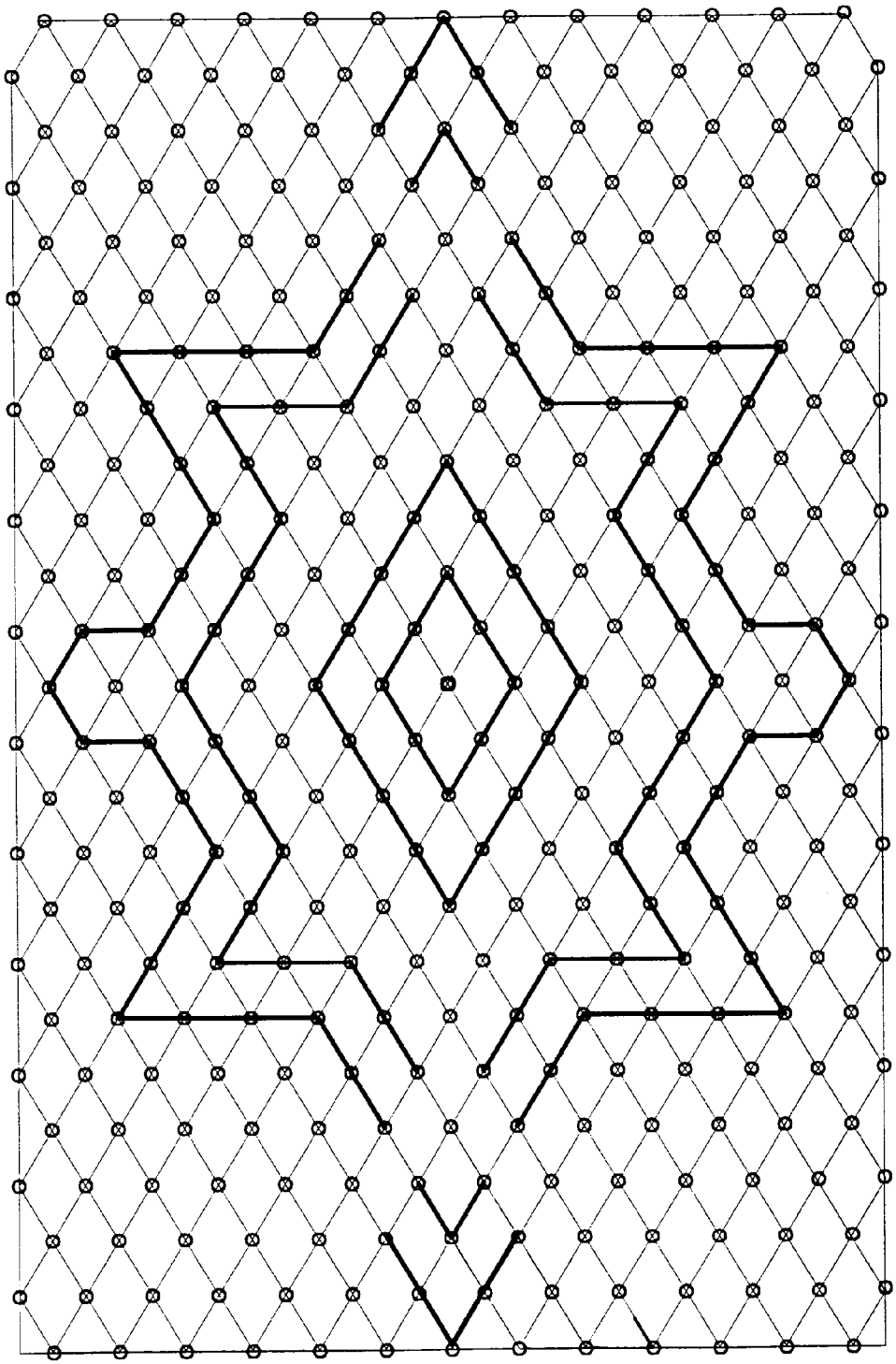
FIGS. 14–17 are schematic views showing available patterns of light flashing of the present invention.
Figure 15:
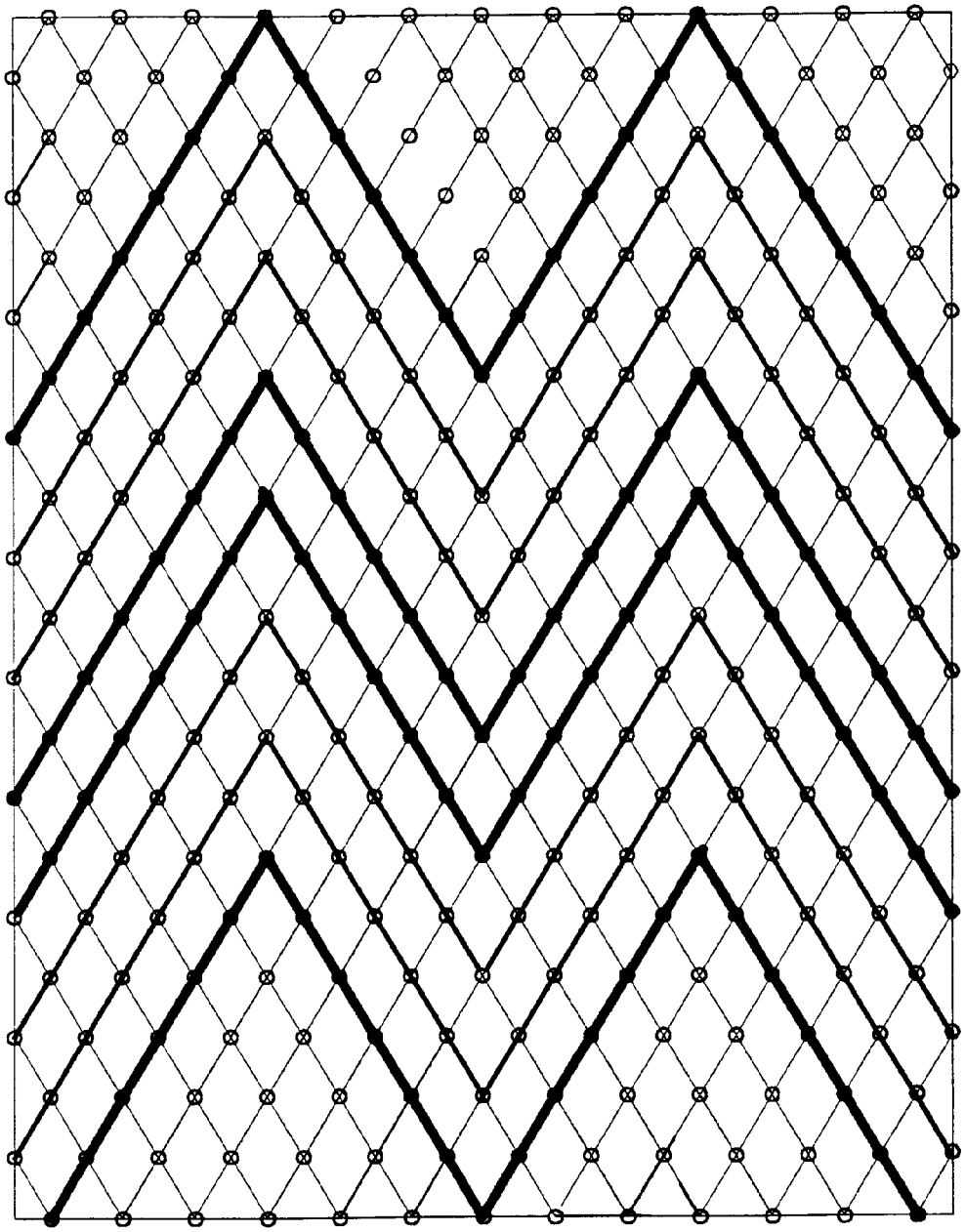
Figure 16:
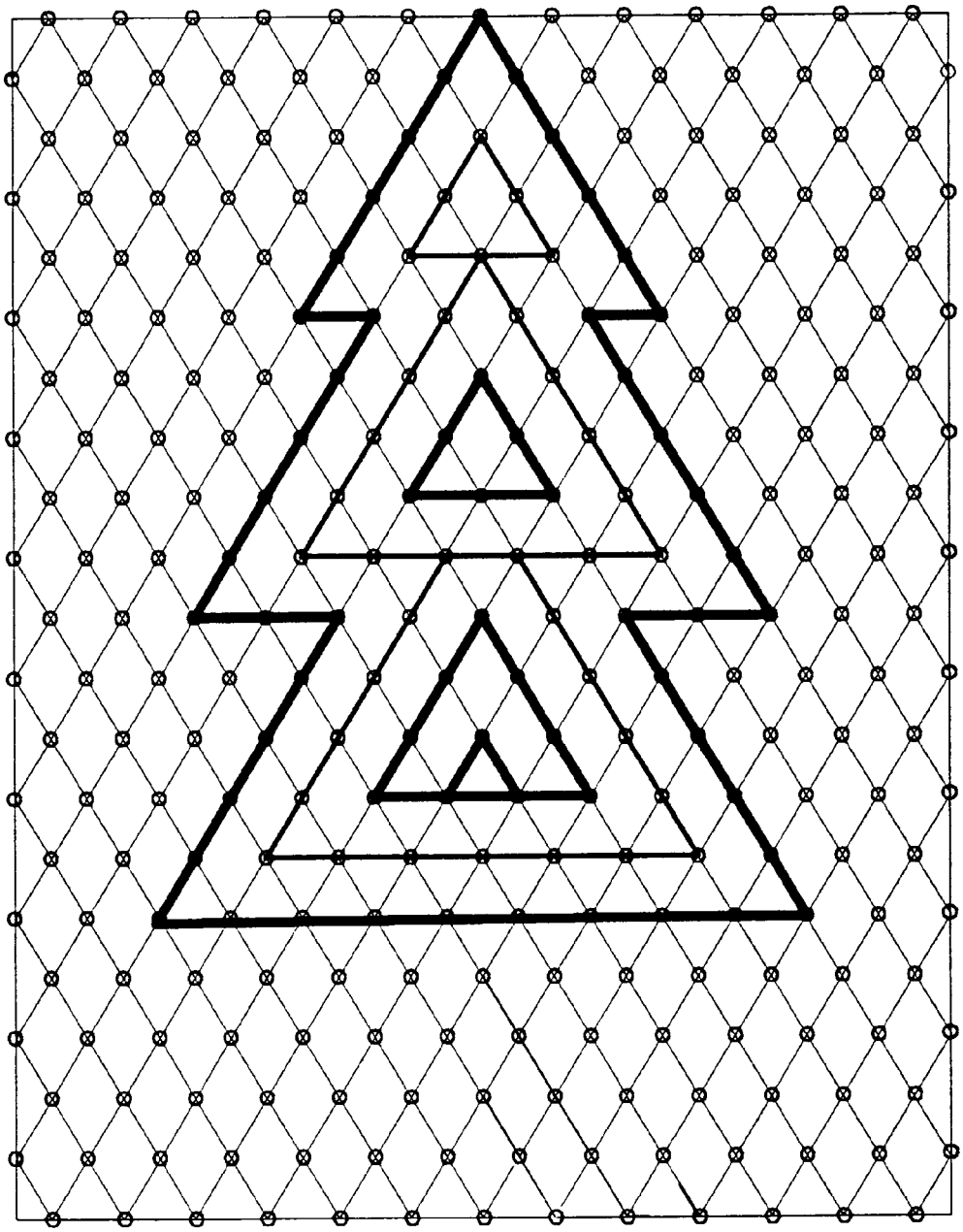
Figure 17:
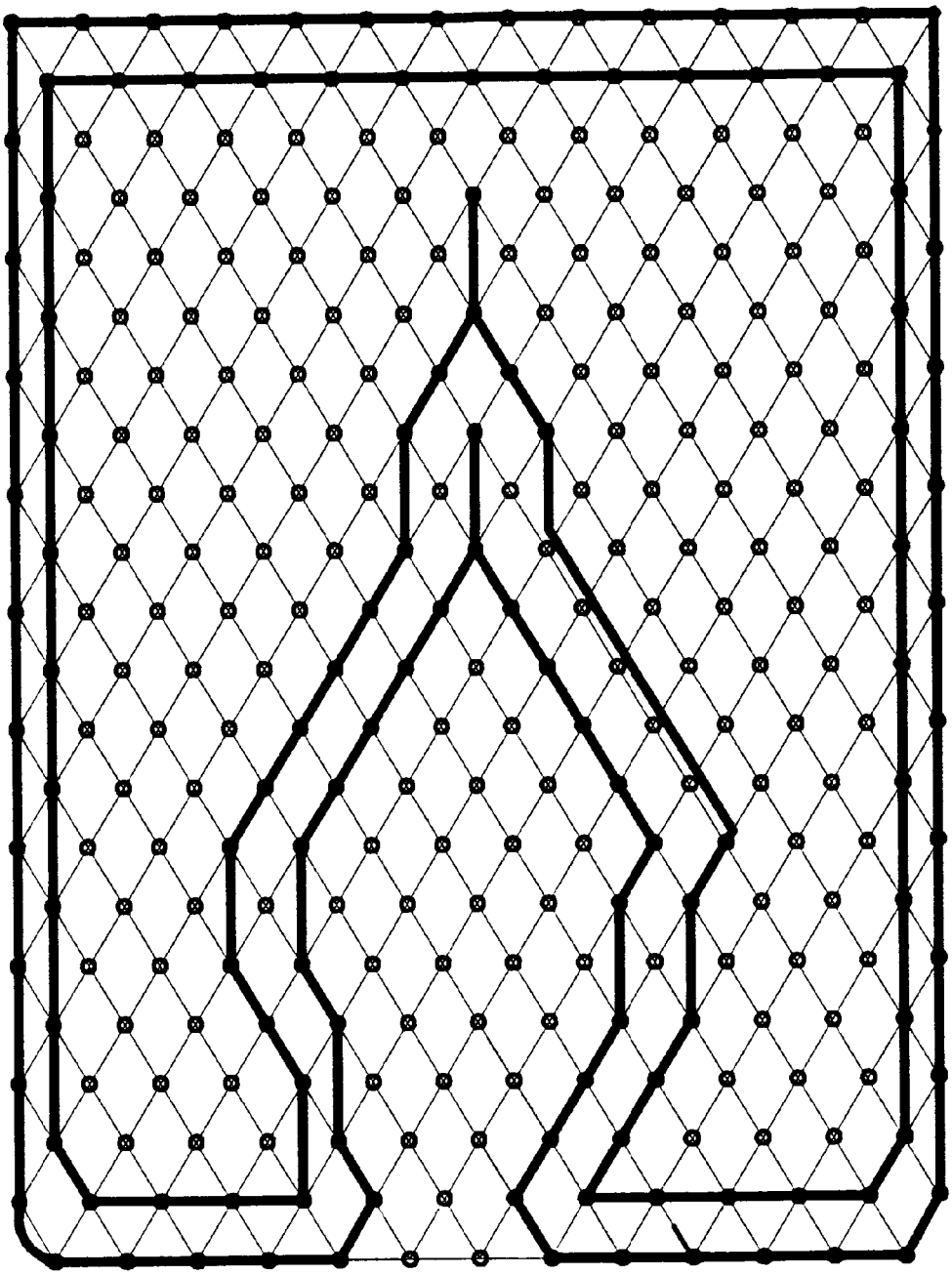

By virtue of the braiding into a matrix and the programming of the related integrated circuit, flashing of a tree shaped lamp decoration can be formed as is shown in FIG. 14; or flashing of an M shaped lamp decoration can be formed as is shown in FIG. 15; or flashing of lamp decoration having the shape of multiple triangles can be formed as is shown in FIG. 16; or flashing of a lamp decoration in the shape as is shown in FIG. 17 can be formed. The whole lamp decoration can have more than 16 kinds of patterns or letters for choice of changing by means of the internal control program of the inner optionally arranged lamp string and control of the external cooperating IC.

Figure 18:
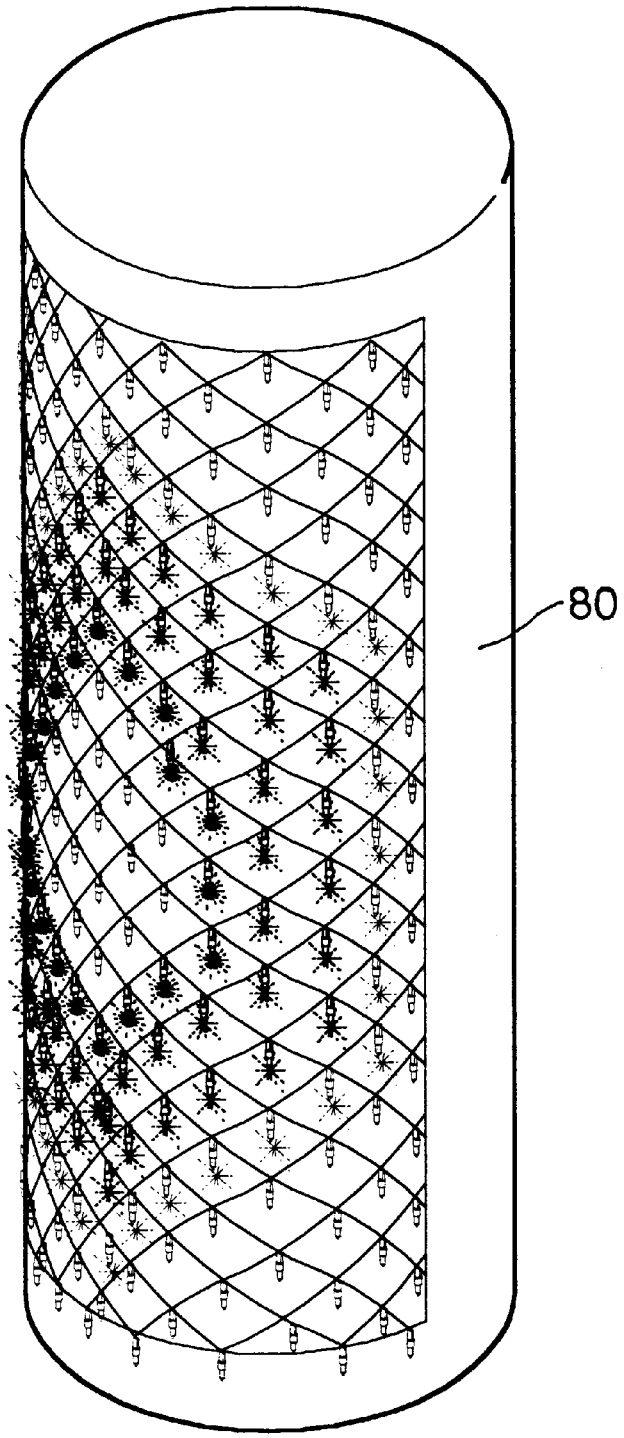
FIG. 18 is a schematic views showing combination of the present invention with a flexible base.
Figure 19:
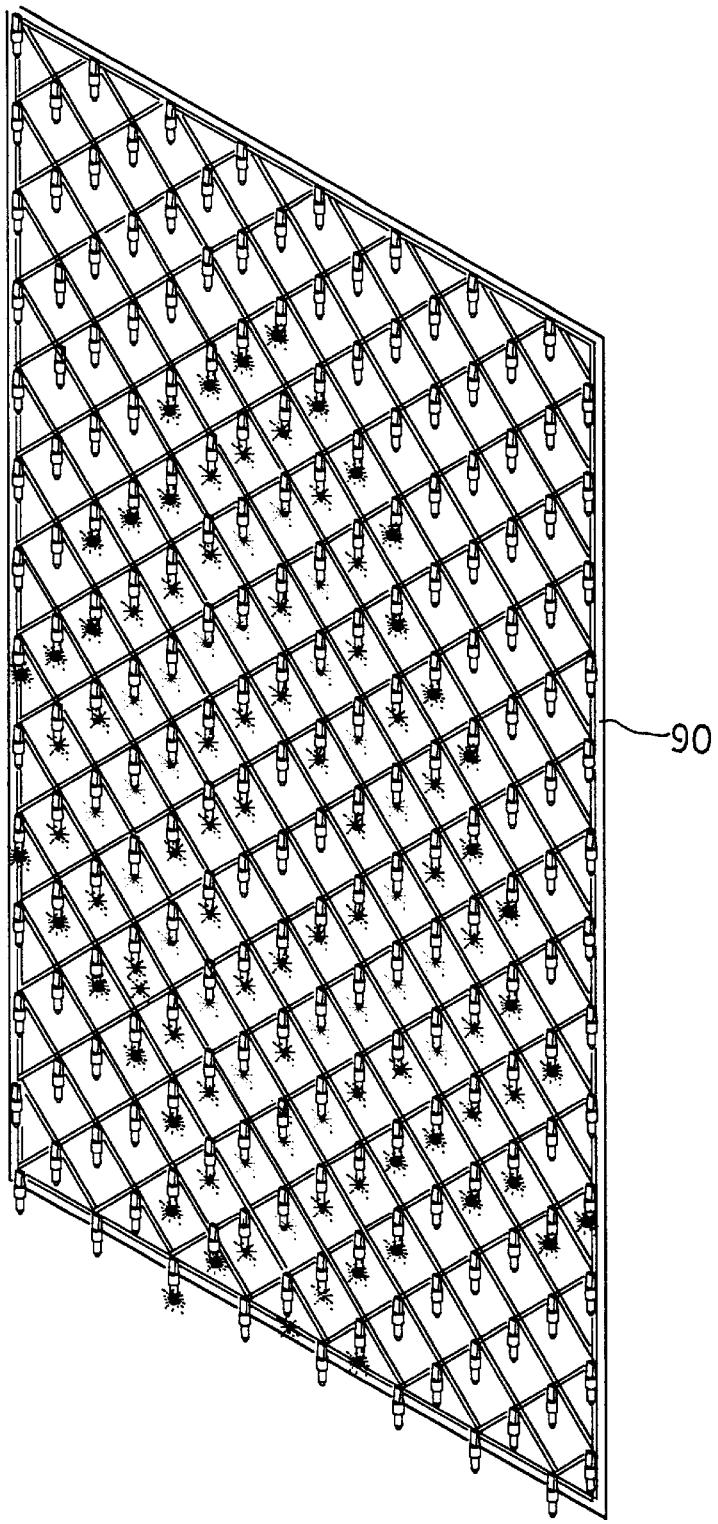
FIG. 19 is a view of an embodiment of the present invention using a hard peripheral frame.

As shown in FIGS. 18 and 19, the whole lamp decoration can be put on the surface of a flexible base 80 such as is shown in FIG. 18, and can certainly be positioned instead in a hard frame 90 such as is shown in FIG. 19.

By means of braiding into a matrix of the whole lamp decoration, using of the inner optionally arranged lamp strings and the outer regularly arranged lamp strings, a variety of lamp decoration patterns or letters can be formed, additionally, an external IC program is used to control to form even polychrestic and more abundant and variant decoration effect.

Having thus described the technical structure of my invention with practicability and improveness, what I claim as new and desire to be secured by Letters Patent of the United States is:

1. A netted lamp device comprising:

a mounting device having a boundary;

a plurality of separate lamp strings located within the boundary of the mounting device, each lamp string having an electrical conductor wire with a plurality of lamp sockets, whereby at least one of the plurality of light strings is out of contact with the boundary of the mounting device and is supported solely by contact of its electrical conductor wire with at least one lamp socket of another lamp string; and, a control circuit located externally of the mounting device and having an integrated circuit connected to the plurality of separate lamp strings through a plurality of switching devices.

2. A netted lamp device as stated in claim 1 wherein the switching devices comprise silicon-controlled rectifiers.

3. A netted lamp device as stated in claim 1, wherein, said integrated circuit is provided in a control box connectable to an electric power supply.

4. A netted lamp device as stated in claim 1, wherein, said mounting device comprises a frame made of flexible material.

5. A netted lamp device as stated in claim 1, wherein, said mounting device comprises a frame made of rigid material.

6. A netted lamp device as stated in claim 1, wherein, said mounting device comprises a flexible base.

* * * * *